US011761251B2

(12) United States Patent
Shepherd

(10) Patent No.: US 11,761,251 B2
(45) Date of Patent: Sep. 19, 2023

(54) LIFTING APPARATUS

(71) Applicant: Siemens Mobility, Inc., New York, NY (US)

(72) Inventor: Richard Shepherd, Sacramento, CA (US)

(73) Assignee: Siemens Mobility, Inc., New York, NY (US)

( * ) Notice: Subject to any disclaimer, the term of this patent is extended or adjusted under 35 U.S.C. 154(b) by 478 days.

(21) Appl. No.: 17/262,293

(22) PCT Filed: Aug. 30, 2018

(86) PCT No.: PCT/US2018/048749
§ 371 (c)(1),
(2) Date: Jan. 22, 2021

(87) PCT Pub. No.: WO2020/046315
PCT Pub. Date: Mar. 5, 2020

(65) Prior Publication Data
US 2021/0301575 A1 Sep. 30, 2021

(51) Int. Cl.
*E05F 1/10* (2006.01)
*E05D 3/14* (2006.01)
*E05D 15/46* (2006.01)

(52) U.S. Cl.
CPC ..... *E05F 1/1091* (2013.01); *E05D 3/145* (2013.01); *E05D 15/46* (2013.01); *E05Y 2201/22* (2013.01);
(Continued)

(58) Field of Classification Search
CPC ..... E05D 3/186; E05D 3/145; E05F 1/1091; B65D 88/127; E05Y 2201/694; E05Y 2900/536; E05Y 2900/50; E05Y 2900/548
See application file for complete search history.

(56) References Cited

U.S. PATENT DOCUMENTS 2,229,315 A 1/1941 Sullivan
3,330,329 A * 7/1967 Ligh ..... B63B 19/197 160/188
(Continued)

FOREIGN PATENT DOCUMENTS

CN 101815836 A 8/2010
CN 203666350 U 6/2014
(Continued)

OTHER PUBLICATIONS

PCT International Search Report and Written Opinion of International Searching Authority dated Apr. 29, 2019 corresponding to PCT International Application No. PCT/US2018/048749 filed Aug. 30, 2018.

*Primary Examiner* — Justin B Rephann

(57) ABSTRACT

A lifting apparatus (100) includes a connector assembly (110) with a first connecting member (120), a second connecting member (130) and a connecting link (140), the first and second connecting members (120, 130) configured to be pivot-mounted at first ends (122, 132) to a first stationary component (200), and a pneumatic supporting member (150) is coupled to the first and second connecting members (120, 130) via the connecting link (140). The connector assembly (110) and the pneumatic supporting member (150) are configured to perform a lifting motion, wherein, when performing the lifting motion, the first and second connecting members (120, 130) transition from a first position (P1) to a second position (P2) and the pneumatic supporting member (150) transitions from an extended position (EP) to a compressed position (CP).

10 Claims, 5 Drawing Sheets

(52) U.S. Cl.
CPC ... *E05Y 2201/478* (2013.01); *E05Y 2201/626* (2013.01); *E05Y 2800/21* (2013.01); *E05Y 2900/51* (2013.01)

(56) References Cited

U.S. PATENT DOCUMENTS 3,747,271 A 7/1973 Adamski
4,587,760 A * 5/1986 Brissette ..... E05D 3/18 49/386
4,724,930 A * 2/1988 VanLierop ..... B66F 7/065 187/206
5,435,406 A * 7/1995 Gaffoglio ..... E05D 3/145 296/146.12
5,749,425 A * 5/1998 Cudden ..... B62D 25/10 180/69.2
6,705,662 B2 * 3/2004 Sande ..... B60J 7/205 296/76
6,916,058 B2 * 7/2005 Krajenke ..... B60J 7/205 296/76
7,769,123 B2 * 8/2010 Rowell ..... G21C 19/207 376/249
8,646,556 B2 * 2/2014 Shimada ..... B62D 25/10 180/69.2
2003/0127876 A1 * 7/2003 Matteo Bucco Morello ..... B60J 5/0498 296/36
2005/0067853 A1 * 3/2005 Krajenke ..... E05D 15/50 296/76
2018/0334321 A1 * 11/2018 Strasser, Sen. ..... E05F 15/53

FOREIGN PATENT DOCUMENTS

CN 204002176 U 12/2014
CN 204370955 U 6/2015
CN 106639714 A 5/2017
DE 102005053574 A1 5/2007
EP 2206864 A1 7/2010
FR 2216833 A5 8/1974
FR 2766514 A1 1/1999
FR 2935732 B1 11/2011
JP S4331786 Y1 12/1968
JP S5748211 U 3/1982
JP S634184 A 1/1988
JP S6385015 A 4/1988
JP H27187 U 1/1990
JP H02108633 U 8/1990
JP H322460 Y2 5/1991
JP 2009084964 A 4/2009
WO 2009060723 A1 5/2009
WO 2016021326 A1 2/2016
WO 2017083895 A1 5/2017

* cited by examiner

LIFTING APPARATUS

BACKGROUND

1. Field

Aspects of the present disclosure relate to a lifting apparatus for lifting a cover or hood, specifically a cover or hood of a vehicle. A vehicle as used herein includes motorized or non-motorized vehicles and can be for example a railed vehicle, a motor vehicle, a watercraft or an aircraft.

2. Description of the Related Art

Lifting equipment or lifting gear is equipment for lifting loads. An example is lifting gear utilized for lifting covers or hoods of vehicles, such as for example cars or railroad vehicles. Known lifting devices include for example a hydraulic motor actuator assisted linkage. Such hydraulic lifting devices include a complex mechanism and hydraulic fluid, wherein handling hydraulic fluid can be difficult in case of leaks. Thus, there may be a need for a simpler yet higher load lifting apparatus.

SUMMARY

A first aspect of the present disclosure provides a lifting apparatus comprising a connector assembly comprising a first connecting member, a second connecting member and a connecting link, the first and second connecting members configured to be pivot-mounted at first ends to a first stationary component, and a pneumatic supporting member coupled to the first and second connecting members via the connecting link, wherein the connector assembly and the pneumatic supporting member are configured to perform a lifting motion, and wherein, when performing the lifting motion, the first and second connecting members transition from a first position to a second position and the pneumatic supporting member transitions from an extended position to a compressed position.

A second aspect of the present disclosure provides a vehicle comprising a lifting apparatus as described herein.

DETAILED DESCRIPTION

To facilitate an understanding of embodiments, principles, and features of the present disclosure, they are explained hereinafter with reference to implementation in illustrative embodiments. In particular, they are described in the context of being a lifting apparatus for lifting a cover or hood, for example of a vehicle. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
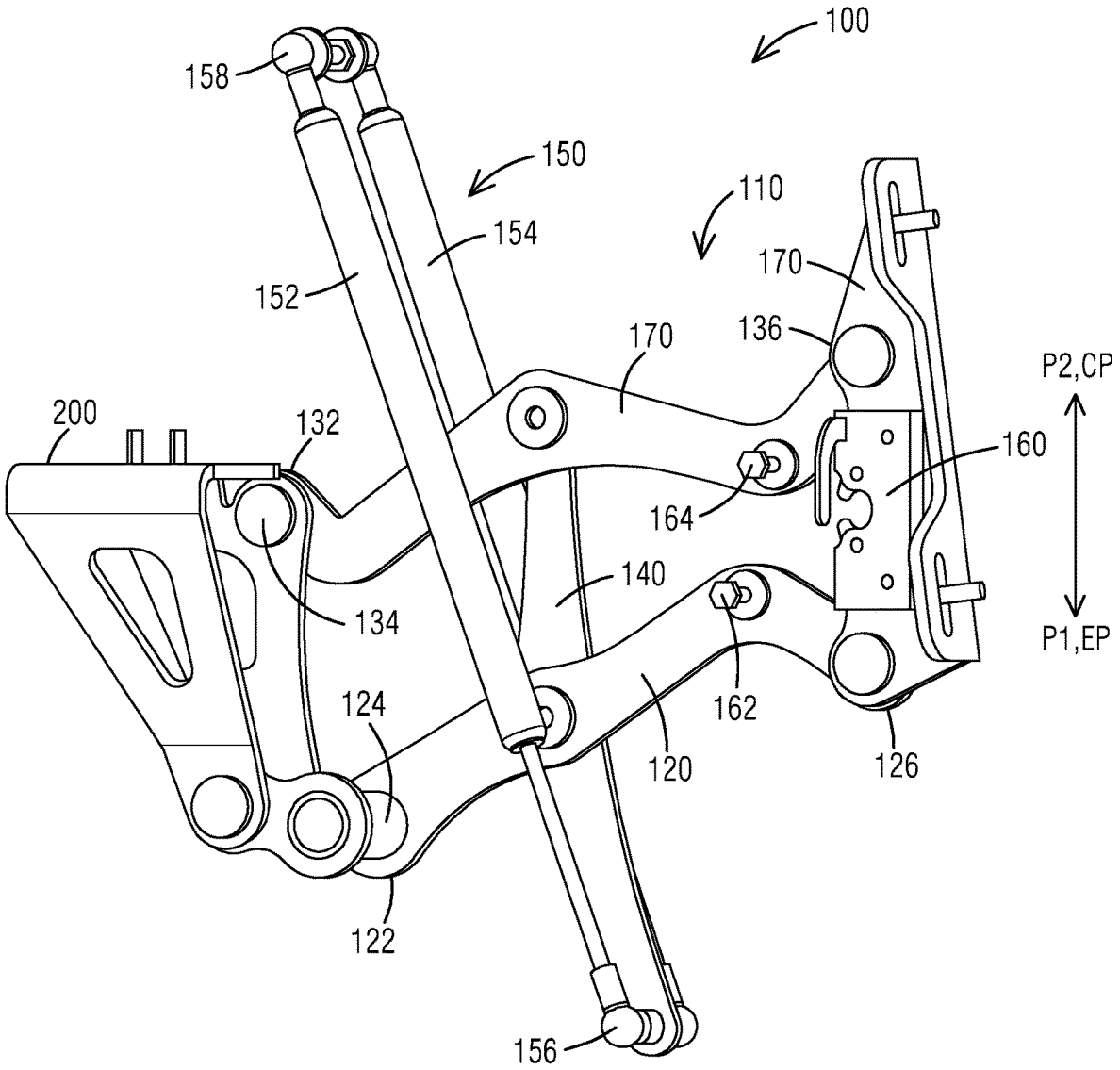
FIG. 1 illustrates a first perspective view of a lifting apparatus in accordance with an exemplary embodiment of the present disclosure.

FIG. 1 illustrates a first perspective view of a lifting apparatus 100 in accordance with exemplary embodiments of the present disclosure.

The lifting apparatus 100 comprises a connector assembly 110. The connector assembly 110 comprises first connecting member 120, second connecting member 130 and connecting link 140. The first and second connecting members 120, 130 are arranged in a substantial parallel manner to each other, though they may not be truly parallel to each other. The first and second connecting members 120, 130 are configured to be pivot-mounted at first ends 122, 132 to a first stationary component 200, which can be for example a component of a vehicle, for example by bolts or screws 124, 134. At second ends 126, 136, which are opposite the first ends 122, 132, the connecting members 120, 130 comprise coupling element 170 for coupling a component 220 to be lifted (see for example FIG. 2). The component 220 to be lifted can comprise a cover or hood of a vehicle, for example a hood of a railroad vehicle, e. g., locomotive or train.

The connecting link 140 is fastened to both connecting members 120, 130, and is substantially perpendicular to the connecting members 120, 130. The connecting link 140 can be fastened to the connecting members 120, 130 by bolts or screws 142, 144, and is arranged essentially centric with respect to a length of the connecting members 120, 130.

The lifting apparatus 100 further comprises a pneumatic supporting member 150 coupled to connector assembly 110, specifically to the first and second connecting members 120, 130, via the connecting link 140. The connector assembly 110 and the pneumatic supporting member 150 are configured to perform a lifting motion, illustrated by the arrow in FIG. 1. When performing the lifting motion, the first and second connecting members 120, 130 transition from a first position P1 to a second position P2 and the pneumatic supporting member 150 transitions from an extended position EP to a compressed position CP (see also FIG. 2-4). Vice versa, when the component 220, e.g. hood or cover, is lowered or closed, the first and second connecting members 120, 130 transition from the second position P2 to the first position P1, and the pneumatic supporting member 150 transitions from the compressed position CP to the extended position EP.

The lifting apparatus 100 utilizes a linkage "booster", comprising the pneumatic supporting member 150, to enhance lift capacity and eliminate the need for hydraulic motor lifting. The pneumatic supporting member 150 is coupled to the connector assembly 110 to achieve higher load lifting. Specifically, the connecting link 140 provides the connection between the connector assembly 110 and pneumatic supporting member 150 for transmitting power of the pneumatic supporting member 150 to the connector assembly 110 when performing a lifting motion.

In accordance with an exemplary embodiment of the present disclosure, the pneumatic supporting member 150 comprises a gas spring 152. Gas springs are energy storage elements that use compressed gas. For example, nitrogen gas and oil can be utilized for providing compressible and damping (motion control) mediums. Gas springs include a precision rod attached to a piston, moving within a sealed cylinder containing the pressurized nitrogen gas and oil. The force is equal to the pressure differential between internal and external pressures, acting on the cross-sectional area of the rod. It should be noted that gas springs will not be explained in further detail herein as one of ordinary skill in the art is familiar with components and function of gas springs.

In accordance with another exemplary embodiment of the present disclosure, the pneumatic supporting member 150 comprises first and second gas springs 152, 154 arranged in parallel to each other. By utilizing multiple gas springs, lift capacity of the lifting apparatus 100 can be increased even further.

Further, as the embodiment of FIG. 1 illustrates, the connecting link 140 is configured such that a maximum length (extension) of the gas spring(s) 152, 154 can be utilized. Thus, the connecting link 140 extends beyond the first connecting member 120 to accommodate the length of the gas spring(s) 152, 154. The gas spring(s) 152, 154 are coupled to connecting link 140 at one end 156, wherein an opposite end 158 of the gas spring(s) 152, 154 is coupled to a stationary component, which can be the same component 200 to which the connecting members 120, 130 are coupled to or a different component.

The lifting apparatus 100 further comprises a latch 160, wherein either the first connecting member 120 or the second connecting member 130 can be engaged in the latch 160 to provide secure connections in different positions. Each of the connecting members 120, 130 comprises a latch pin 162, 164 which can engage in the latch 160 depending on a position P1, P2 of the connecting members 120, 130 (see also FIG. 2-4).

Figure 2:
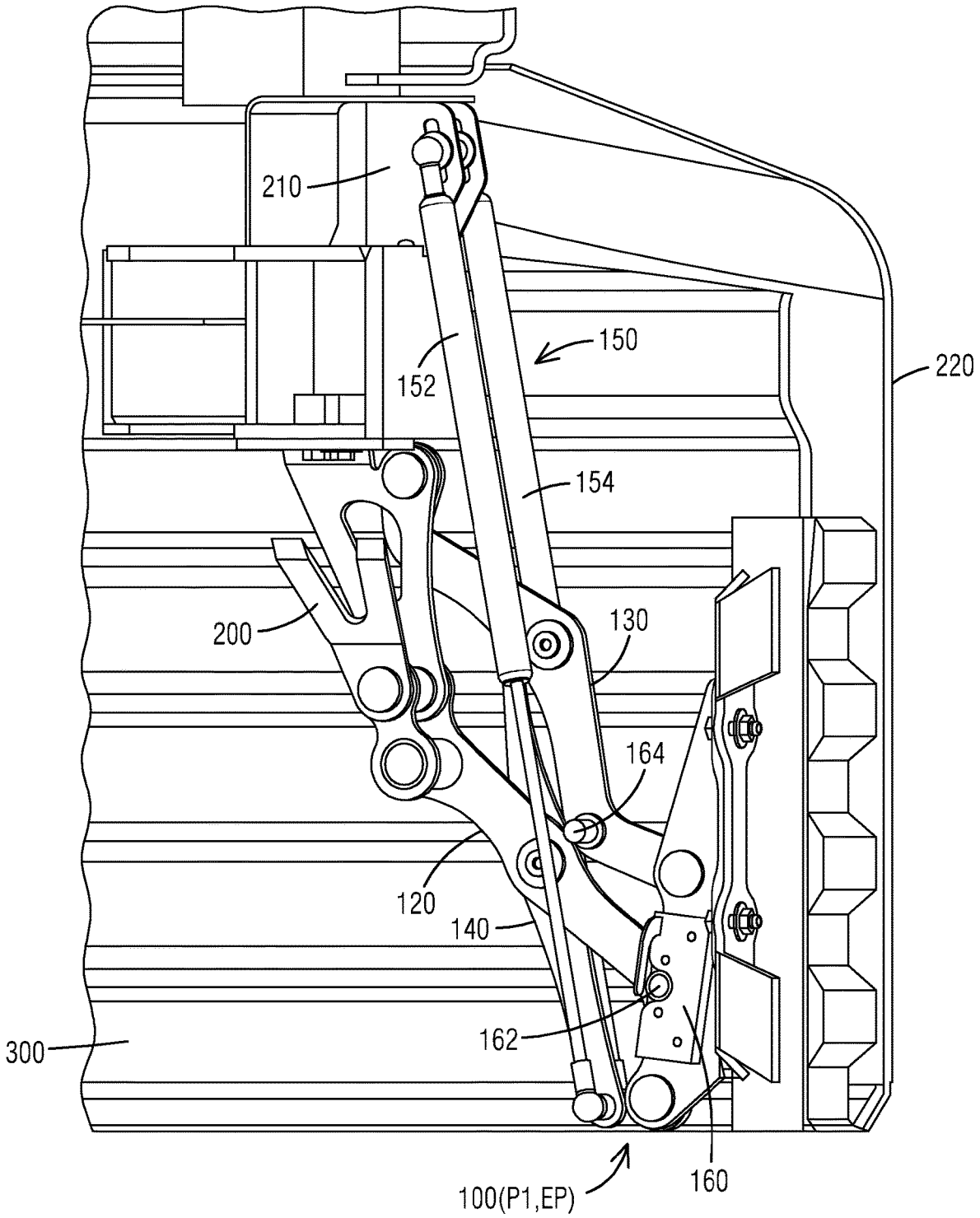
FIG. 2 illustrates a second perspective view of a lifting apparatus in accordance with an exemplary embodiment of the present disclosure.
Figure 3:
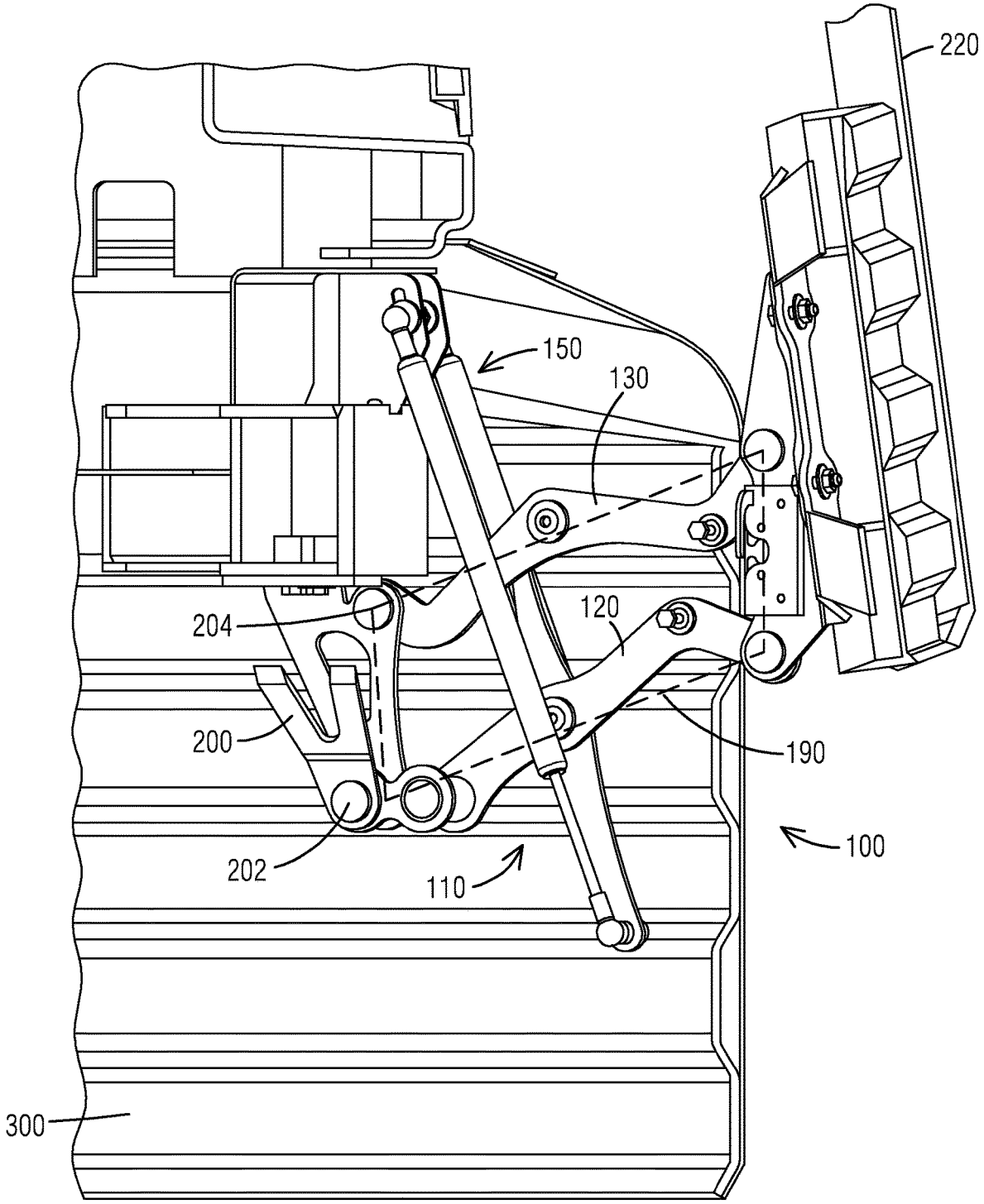
FIG. 3 illustrates a third perspective view of a lifting apparatus in accordance with an exemplary embodiment of the present disclosure.
Figure 4:
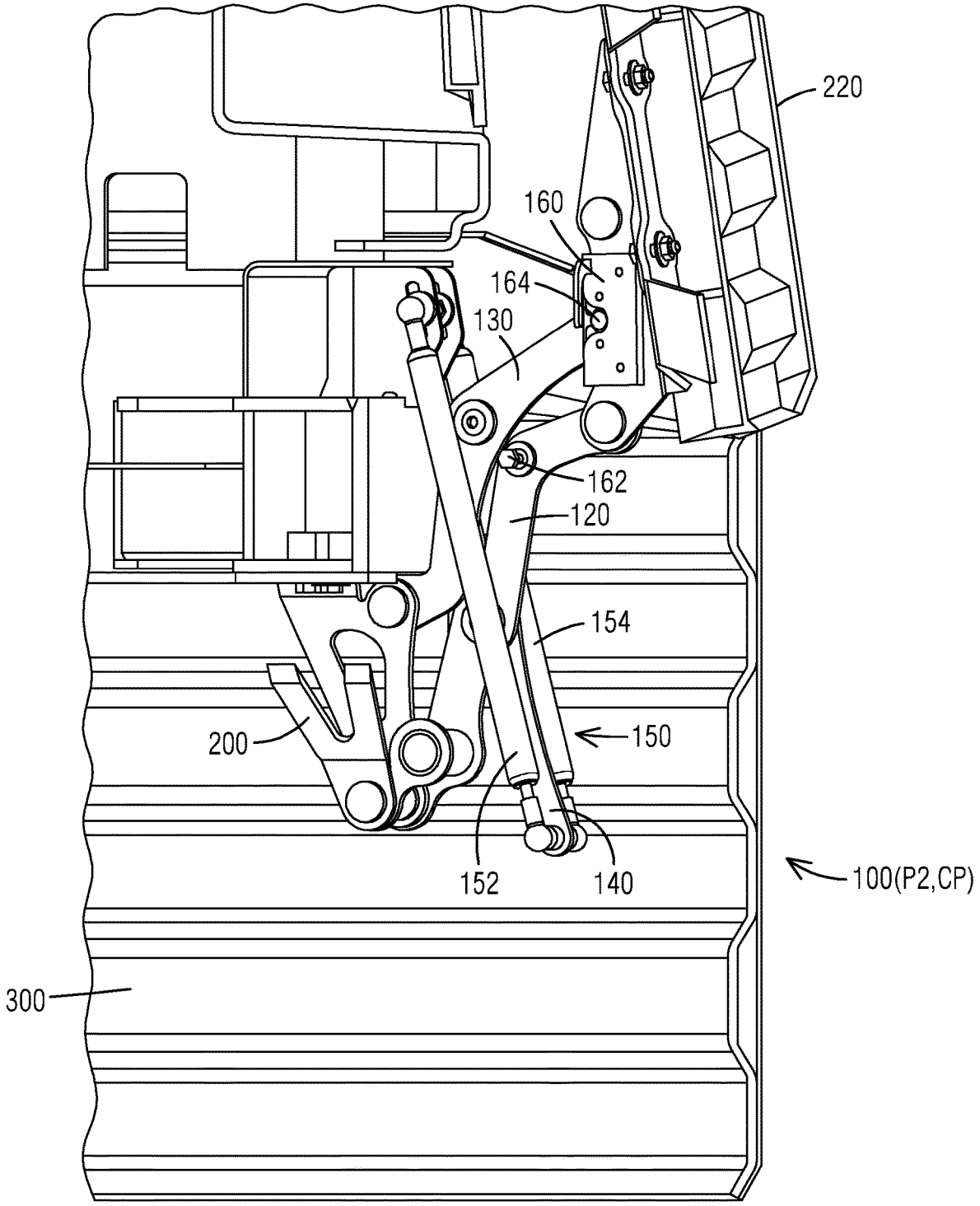
FIG. 4 illustrates a fourth perspective view of a lifting apparatus in accordance with an exemplary embodiment of the present disclosure.

FIG. 2, FIG. 3 and FIG. 4 illustrate multiple perspective views of the lifting apparatus 100 in accordance with an exemplary embodiment of the present disclosure. FIG. 2 illustrates a second perspective view of the lifting apparatus 100 in a first position P1 and extended position EP in combination with a section of a vehicle 300.

The vehicle 300 can be a motorized or non-motorized vehicle such as for example a railway vehicle, a motor vehicle including cars, coaches and busses, a watercraft, an aircraft, a spacecraft etc. The embodiments disclosed herein are primarily described in connection with railway vehicles, such as for example streetcars, light rail vehicles, automatic (airport) shuttles, metros, commuter trains, EMUS (Electric Multiple Units), DMUs (Diesel Multiple Unit), and high-speed trains etc. The lifting apparatus 100 is installed for lifting a cover or hood 220 of the vehicle 300. For example, the cover or hood 220 can be a coupler cover of a train. A coupler (or a coupling) is a mechanism for connecting rolling stock in a train.

The first position P1 corresponds to a closed position because the cover or hood 220 of the vehicle 300 is closed. Further, the pneumatic supporting member 150 is in an extended position EP. When in the extended position EP, the pneumatic supporting member 150, e. g. gas spring(s) 152, 154, is pre-loaded. In the first position P1/extended position EP, the first connecting member 120 is engaged in the latch 160. Specifically, the latch pin 162 is engaged in the latch 162. Thus, the cover or hood 220 is securely closed.

The pneumatic supporting member 150 is adapted to be coupled to a second stationary component 210, specifically a component 210 of the vehicle 300. The connector assembly 110 is coupled to first stationary component 200 of the vehicle 300. The stationary components 200, 210 can be the same component of the vehicle 300 or different components. Also, the components 200, 210 can be many different components of the vehicle 300 as long as they are suitable and provide enough support and stability for the lifting apparatus 100.

FIG. 3 illustrates a third perspective view of the lifting apparatus 100 in a 'middle' position in combination with the section of the vehicle 300. The lifting apparatus 100, specifically the connector assembly 110 and the pneumatic supporting member 150, transition from the first position P1/extended position EP as shown in FIG. 1 to a second position P2/compressed position CP as shown in FIG. 4 when performing a lifting motion. During a lifting motion, the first and second connecting members 120, 130 pivot or rotate around parallel axes of the stationary component 200. The parallel axes can be for example axes of bolts or screws 202, 204 which are used to pivot-mount the connecting members 120, 130 to the stationary component 200. Further, during the lifting motion, the pneumatic supporting member 150 enhances or 'boosts' the lifting motion, wherein force or power of the supporting member 150 is transmitted to the connector assembly 110 and thus enhances and improves lifting of the cover or hood 220 via the connecting link 140.

Figure 5:
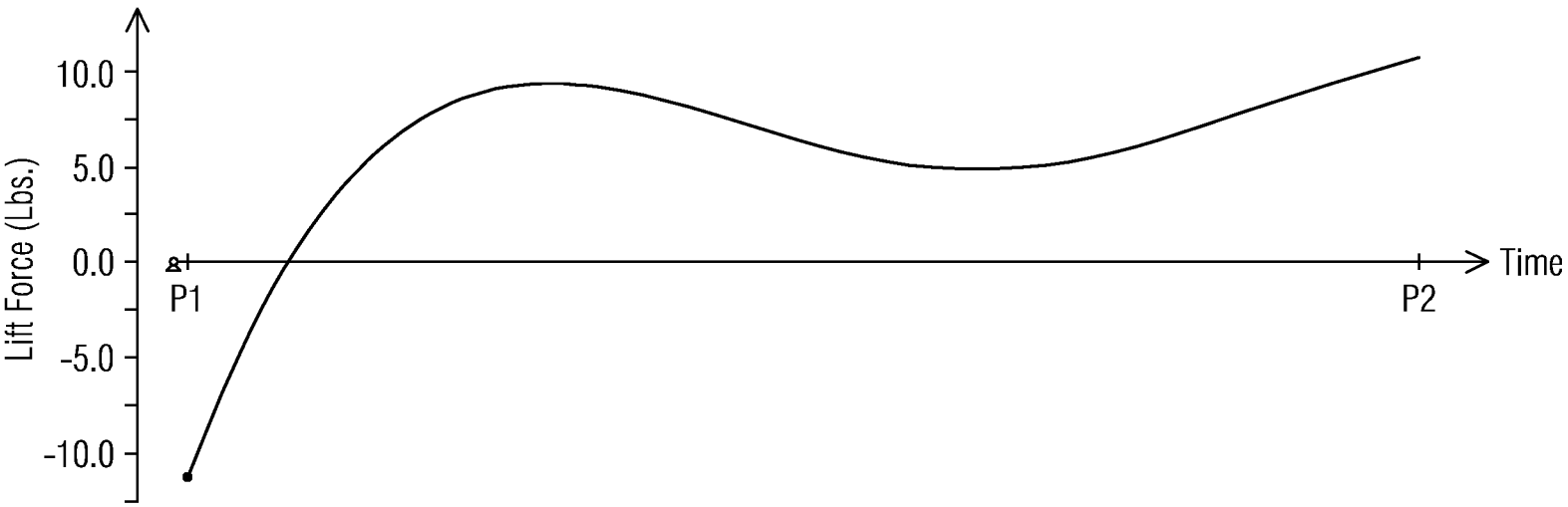
FIG. 5 illustrates a diagram comprising lift force over time of a lifting apparatus in accordance with an exemplary embodiment of the present disclosure.

In accordance with an exemplary embodiment of the present disclosure, the first and second connecting members 120, 130 of the connector assembly 110 form a main 4-bar link, labeled with reference numeral 190. The 4-bar link 190 may also comprise components 170, 200 which are the components the connecting members 120, 130 are coupled to at their respective ends. However, the connecting members 120, 130 may be coupled to (other) vehicle components directly without the "intermediate" components 170, 200. Further, the connecting link 140 may also be considered part of the main link 190, which may then be referred to as main 5-bar link. Essentially, the connector assembly 110 with first and second connecting members 120, 130 and connecting link 140 forms the main 4-bar link 190. A shape of the main 4-bar link 190 is designed and specialized so that the first and second connecting members 120, 130 permit control of how a weight of the cover or hood 220 is lifted. Specifically, shapes of the connecting members 120, 130, are matched to lift characteristics of the supporting member 150, e.g., gas springs 152, 154, the lift characteristics being progressive. Further, the connecting link 140 is adapted and responsible for allowing fine tuning for a desired "lift force"-graph output, as illustrated in FIG. 5.

FIG. 4 illustrates a fourth perspective view of the lifting apparatus 100 in a second position P2 in combination with a section of a vehicle 300. The second position P2 corresponds to an open position because the cover or hood 220 of the vehicle 300 is lifted or open. Further, the pneumatic supporting member 150, comprising for example gas spring(s) 152, 154, is in a compressed position CP. When in the compressed position CP, the pneumatic supporting member 150, e. g. gas spring(s) 152, 154, is/are compressed.

In the second position P2 which is also the compressed position CP of the supporting member 150, the second connecting member 130 is engaged in the latch 160. Specifically, the latch pin 164 is engaged in the latch 160. Thus, the cover or hood 220 is in a secure position when lifted.

The connector assembly 110 with the connecting link 140 allows a maximum length of the pneumatic supporting member 150, specifically of the gas spring(s) 152, 154, to be ran in parallel for high load lift capacity. Further, design and placement of the connector assembly 110 and pneumatic supporting member 150 permit leverage corrections needed for a steady low opening/closing effort. The lifting apparatus 100 features both open and closed lock positions using single latch 160.

FIG. 5 illustrates a diagram comprising lift force over time of the lifting apparatus 100 in accordance with an exemplary embodiment of the present disclosure. FIG. 5 illustrates a "lift force"-graph output with respect to a transition from the first (closed) position P1 to the second (open) position P2 in combination with lift force (in pounds, also referred to as lbs, wherein 1 lbs is equal to about 0.45 kilogram). As the graph output shows, a large amount of force is required to open the cover or hood 220 about 30% (⅓). When the cover or hood 220 is about ⅓ open, the cover or hood 220 already comprises a large amount of back rotation which is essential to even out an effort needed to perform opening/closing action of the cover 220 despite highly progressive gas spring(s) 152, 154.

The invention claimed is:

1. A lifting apparatus comprising:

a connector assembly comprising a first connecting member, a second connecting member and a connecting link, the first and second connecting members configured to be pivot-mounted at first ends to a first stationary component, and a pneumatic supporting member coupled to the first and second connecting members via the connecting link, wherein the connector assembly and the pneumatic supporting member are configured to perform a lifting motion, and wherein, when performing the lifting motion, the first and second connecting members transition from a first position to a second position and the pneumatic supporting member transitions from an extended position to a compressed position, and further comprising:

a latch, wherein the first connecting member is engaged in the latch when in the first position, and the second connecting member is engaged in the latch when in the second position.

2. The lifting apparatus of claim 1, wherein the pneumatic supporting member is adapted to be coupled to a second stationary component.

3. The lifting apparatus of claim 1, wherein the pneumatic supporting member comprises a gas spring.

4. The lifting apparatus of claim 1, wherein the first and second connecting members each comprise a latch pin for engaging in the latch.

5. The lifting apparatus of claim 1, wherein the connector assembly further comprises a coupling element at second ends of the connecting members for coupling a component to be lifted.

6. The lifting apparatus of claim 1, wherein the supporting member comprises a first gas spring and a second gas spring arranged in parallel to each other.

7. The lifting apparatus of claim 1, wherein the first and second connecting members pivot when performing the lifting motion.

8. The lifting apparatus of claim 1, wherein the component to be lifted comprises a hood or cover of a railway vehicle.

9. A vehicle comprising a lifting apparatus as claimed in claim 1.

10. The vehicle of claim 9, wherein the vehicle is a railway vehicle.

* * * * *